US005299177A

United States Patent [19]

Koch

[11] Patent Number: 5,299,177

[45] Date of Patent: Mar. 29, 1994

[54] ANALOG TIMEPIECE ABLE TO DISPLAY ADDITIONAL INFORMATION

[75] Inventor: Daniel Koch, Crémines, Switzerland

[73] Assignee: ETA SA Fabriques d'Ebauches, Granges, Switzerland

[21] Appl. No.: 113,068

[22] Filed: Aug. 30, 1993

[30] Foreign Application Priority Data

Sep. 25, 1992 [CH] Switzerland ..... 03004/92

[51] Int. Cl.[5] ..... G04B 23/02; G04B 19/24; G04B 19/04

[52] U.S. Cl. ..... 368/73; 368/28; 368/80

[58] Field of Search ..... 368/28, 31, 34, 72–74, 368/76, 80, 223, 228, 250, 251

[56] References Cited

U.S. PATENT DOCUMENTS 4,266,288 5/1981 Berney .
4,398,832 8/1983 Maire et al. ..... 368/76
4,470,707 9/1984 Chambon et al. .
4,652,140 3/1987 Nakazawa ..... 368/74
5,172,349 12/1992 Triponez et al. .
5,177,715 1/9193 Bonvin .
5,245,591 9/1993 Katui ..... 368/80

FOREIGN PATENT DOCUMENTS 0175961 9/1985 European Pat. Off. .
0393606 10/1990 European Pat. Off. .
0476425 3/1992 European Pat. Off. .
2404250 4/1979 France .

*Primary Examiner*—Vit W. Miska
*Attorney, Agent, or Firm*—Pollock, Vande Sande & Priddy

[57] ABSTRACT

An analog timepiece has an hour and a minute hand which may show either the time in a normal manner or information other than the time. When the timepiece is in its normal time display mode, a display function may be activated to display information other than the time by means of external command means. When this function is activated, the hands are superimposed and selectively occupy together the same angular position representative of the information apart from an indication of the time.

3 Claims, 4 Drawing Sheets

ANALOG TIMEPIECE ABLE TO DISPLAY ADDITIONAL INFORMATION

The instant invention relates to an analog timepiece, in particular an analog watch, capable of displaying at least one additional item of information as well as an indication of the time.

More specifically, the instant invention relates to an analog timepiece capable of displaying at least one additional item of information apart from an indication of the time by means of hands, and in particular by means of hour and minute hands.

DESCRIPTION OF THE PRIOR ART

Timepieces are known which are capable of displaying additional information apart from an indication of the time by means of hands. French patent 2 404 250, in particular, describes a timepiece having an hour hand, a minute hand and external command means to display by means of the hands certain items of information apart from the indication of the time. When the user of a watch of this type triggers the display of information other than the indication of the time by means of external command means, a command circuit inside the watch generates motor impulses which cause the displacement of one of the hands independent of the other to displace this hand to a position in which it displays this information. While this display of an additional function lasts, the other hand can, depending on the situation, either remain in the position which it occupied before the triggering of the display of this information other than an indication of the time, or move to display a second item of information of the same type.

BACKGROUND OF THE INVENTION

Timepieces using a display mode such as that described hereinabove have disadvantages. The presence of at least two hands occupying different positions on the dial can cause reading errors Whereas the presence of several hands on the dial is necessary to provide an clear and accurate analog indication of the time, this arrangement leads to risks of confusion as soon as the hands are used to display information other than an indication of the time. The reason for this is that if the user has always been accustomed, or even conditioned, to read the time in the form of information composed either of a couple of parameters (hours, minutes) determined by the positions of the two hands, or by three parameters (hours, minutes, seconds) determined by the positions of the three hands, the same does not apply to other types of information which have to be displayed in the form of a single parameter with the aid of a single isolated indicator (disc, crown), if one does not wish to make their reading unnecessarily complicated. Under these circumstances, the presence on a watch of several hands, each occupying a different position on the dial, and thus each supplying an indication, would necessarily lead to a source of confusion as soon as the information which they display is not the time.

OBJECTS OF THE INVENTION

One object of the instant invention is thus to overcome these disadvantages of the prior art by providing an analog timepiece able to display the time in a conventional manner, notably by means of two hands and also able to display information other than an indication of the time by means of these hands in a manner which lends itself to easy and immediate reading and which avoids the risks of confusion which have just been described.

BRIEF SUMMARY OF THE INVENTION

It is therefore an object of the instant invention to provide an analog time piece comprising at least an hour hand and a minute hand, respectively driven by first and second electro-mechanical means, manual command means and an electronic circuit providing a time base, a counter circuit giving information on at least the hour and the minute, and electronic control means for generating a command signal for the displacement of the hands, said electronic circuit further comprising means for acquiring, processing and providing said control means with information apart from the time of day, said control means being arranged so as to, in response to a signal generated by said command means, cause said hands to indicate an information other than the time of day, wherein the hands are made to indicate said information other than the time of day by being driven to selectively superpose themselves in an angular position corresponding to said information other than the time of day.

The display of the information, apart from the time, being effected by the hands in superposed position and which thus both simultaneously indicate the same position on the dial, confusion is no longer possible and reading of the information is made particularly easy.

Another advantage of the instant invention is that the display of non-time information does not risk being confused with an indication of the time.

BRIEF DESCRIPTION OF THE DRAWINGS

Other features and advantages of the invention will appear from a study of the detailed description of two embodiments of the instant invention. The following description is made with reference to the appended drawings which are given solely by way of example and in which:

FIG. 1 shows in block diagram form an alarm watch constituting an embodiment of the instant invention. This alarm watch comprises in series a quartz oscillator 2, a graduation chain 4 delivering a signal of 1 Hz, a second hand position counter 6 and a minute hand position counter 8. It also comprises a divider by twelve having reference numeral 10 receiving the signal from the second hand position counter 6, and an hour hand position counter 12, the input of which is connected to the output of the divider 10. The counters 6, 8 and 12 are counters by sixty, the mode of operation of which is described diagrammatically in FIG. 3.

DETAILED DESCRIPTION OF THE PREFERRED EMBODIMENTS OF THE INVENTION

Figure 3:
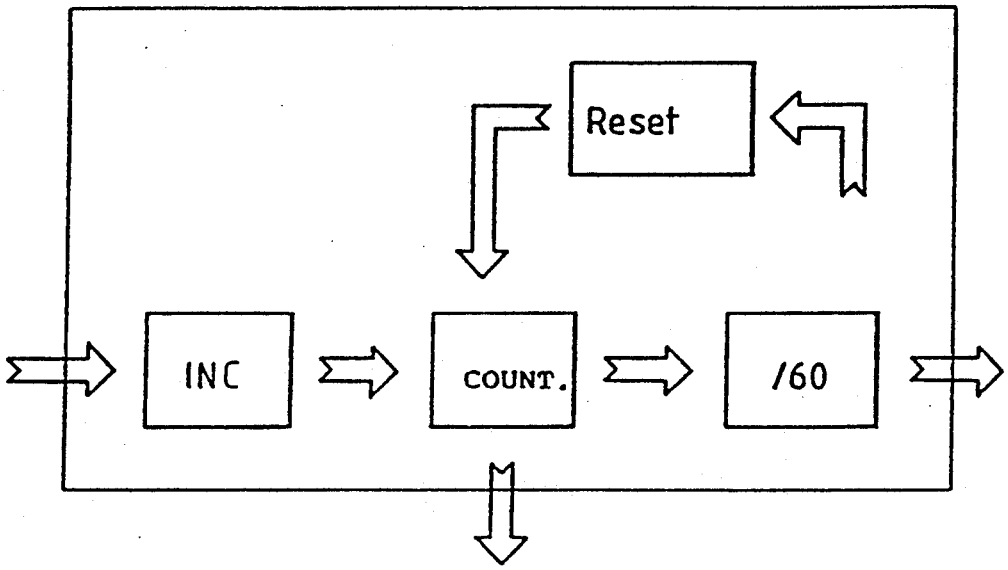
FIG. 3 is a functional diagram of a position counter identical to the three position counters shown in FIG. 1.

As shown in FIG. 3, the impulses to be counted are supplied to the counter (arrow at the far left of the diagram). These successive impulses are counted by a binary register of at least six bits in an increasing manner. The state of this register can be read at any moment (arrow towards the bottom of the diagram). At each increment, the register is tested to see if the number which it contains is equal to sixty. If this is the case, the test circuit emits an impulse and this impulse causes the register to return to zero (reset). The test circuit thus constitutes a divider by sixty, the signal of which can be transmitted to a different counter (arrow on the right of the diagram).

The counters 8 and 12 (FIG. 1) define, in normal mode, the position of the minute and hour hands in relation to the dial of the timepiece. Because the alarm watch described herein does not have a second hand, the second hand position counter only serves to generate a signal to increase the other counters 8, 12 by increments.

Figure 2:
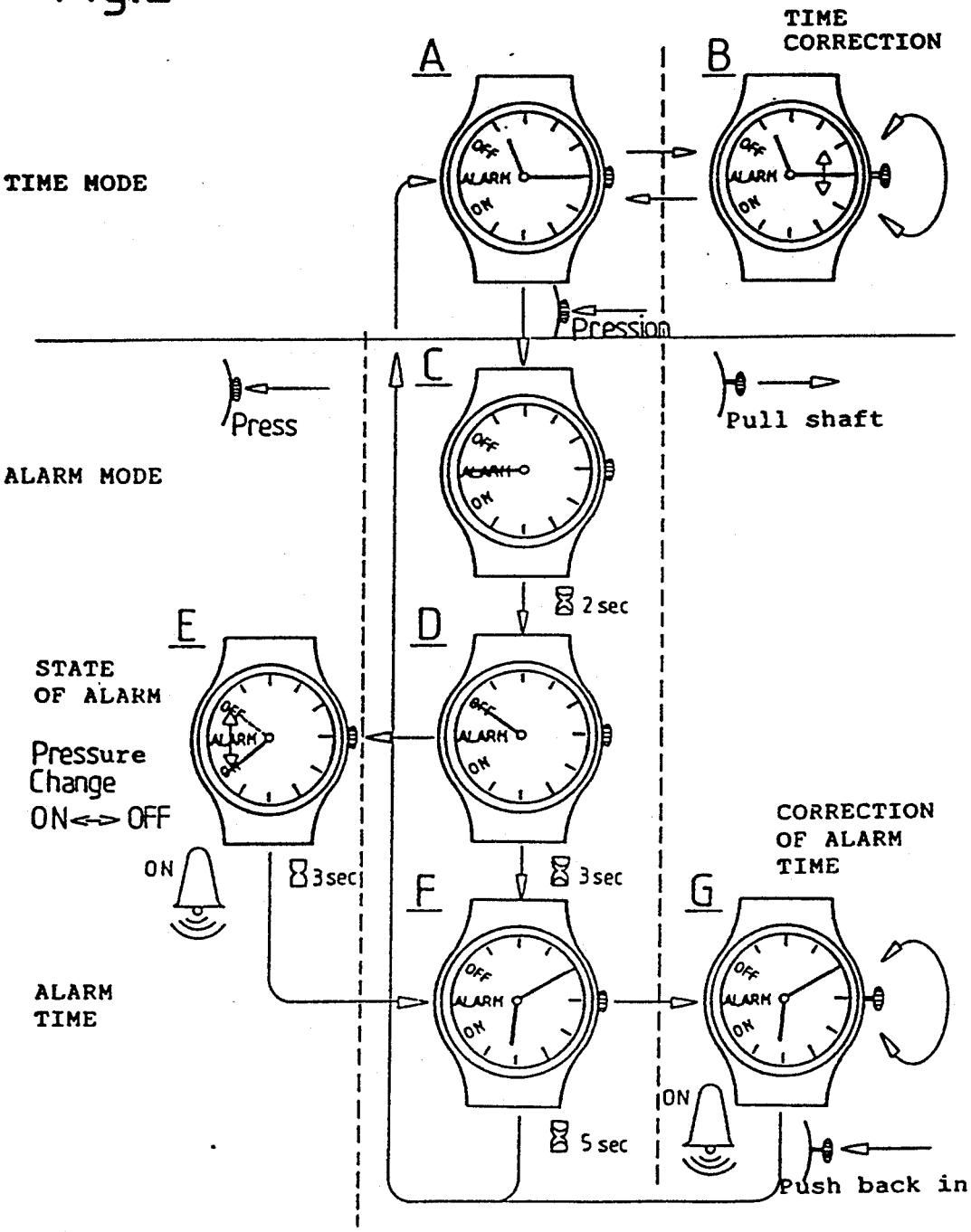
FIG. 2 is a table or organizational chart of the various display functions fulfilled by the hands of the alarm watch shown in FIG. 1.

The timepiece is also provided with two motors 18 and 20 commanded by energy circuits 14, 16 respectively to drive the minute hand and the hour hand respectively (FIG. 2). The circuits 14, 16 receive, in normal mode, the impulses applied respectively to the inputs of the position counters of the minute hand 8 and the hour hand 12.

The arrangement of the motors and of the gears of the instant alarm watch will not be described herein. Horological movements are already known comprising several motors to drive the hands individually. European patent 0 393 606, in particular, describes a horological movement comprising two motors able to drive the minute and hour hands independently.

Figure 1:
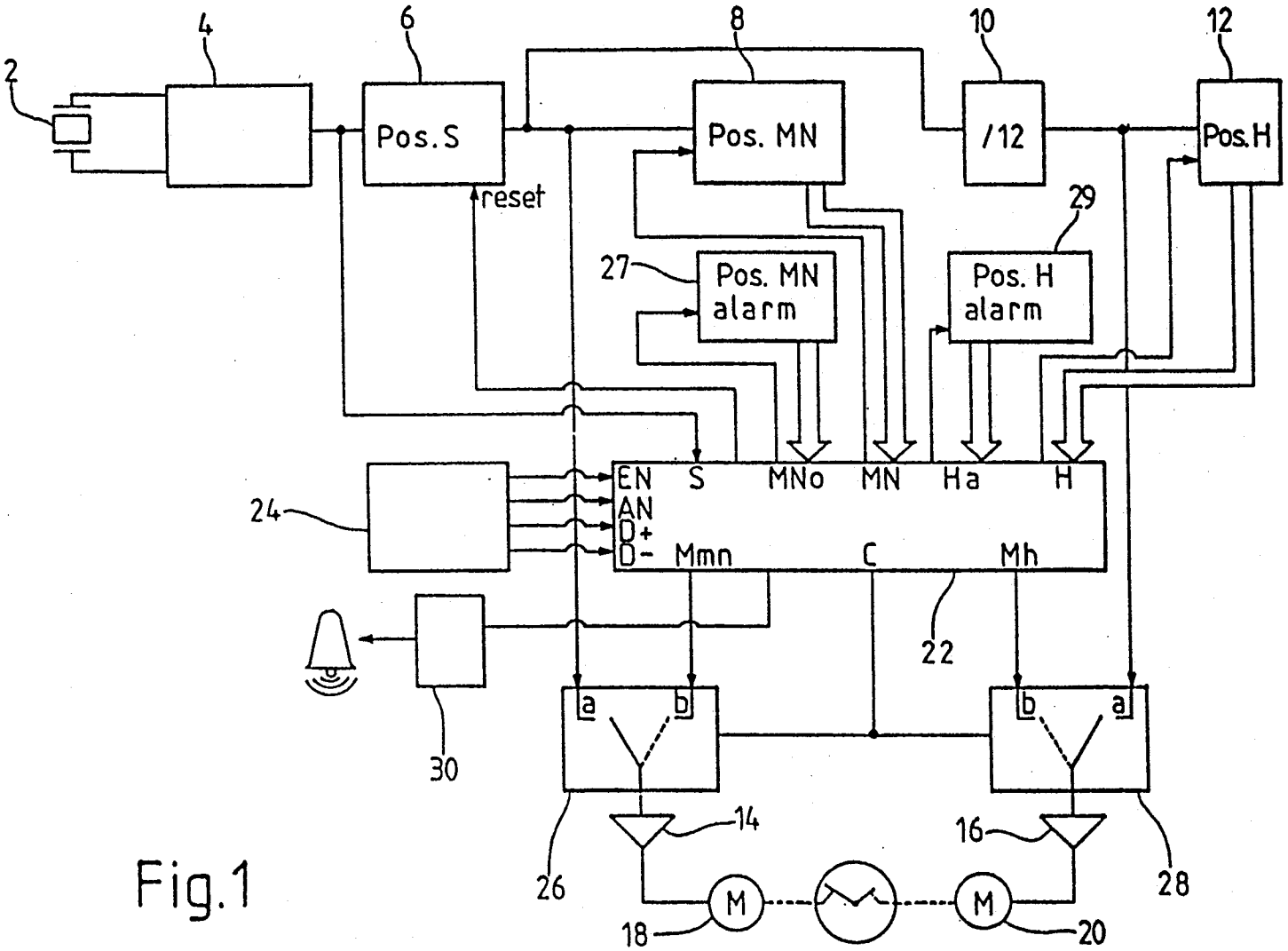
FIG. 1 represents in the form of a block diagram an alarm watch which constitutes a first embodiment of the instant invention.

The elements of the watch alarm shown in the block diagram of FIG. 1 which have just been described describe the functioning of this timepiece with regard to the normal display of the time. However, according to the instant invention, the watch described herein can also display information apart from the indication of the time. The elements of FIG. 1 which will now be described make it possible on the one hand to display additional information and, on the other hand, to return the hands to the display position of the exact time when this is necessary.

As shown in FIG. 1, the timepiece comprises electronic control means 22 to permit the alarm watch to fulfill various display functions and an alarm function. These electronic control means 22 have inputs MN and H to receive the minute 8 and hour 12 counters, two activation inputs AN, EN and two inputs $D^+$, $D^-$ for the data on forwards and backwards displacement of the hands respectively.

The signals applied to the inputs AN, EN, $D^+$ and $D^-$ are supplied by a circuit 24 for interpreting the position and displacement of the command shaft. The operation of the command shaft and of the interpretation circuit 24 will not be described in detail here since devices of this type are already known to the person skilled in the art. European patent 0 175 961, in particular, describes a command shaft associated with an interpretation circuit that can easily be adapted to be used with the timepiece described herein.

The electronic control means 22 also have two outputs Mmn and Mh to deliver impulses to the motors 18 and 20, and a command output C to control the state of two switches 26, 28 arranged at the input of the energy circuits 14, 16 and disposed to transmit to them either the impulses applied to the inputs of the minute hand 8 and hour hand 12 position counters when the switches are in a first position with reference a, or the impulses delivered by the electronic control means 22 when the switches are in a second position with reference b.

The electronic control means can advantageously be provided in the form of an integrated circuit having a programmed micro controller. The person skilled in the art will be able to program the micro controller on the basis of the information provided herein so as to execute the functions described.

In the normal time display mode, the electronic control means are inactive and the motors 18, 20 receive impulses applied to the inputs of the position counters of the minute and hour hands 8, 12.

The table or organizational chart of FIG. 2 has seven arrangements or stages (with references A to G) each representing one of the different display functions capable of being fulfilled by the hands of the watch. The arrows which connect the different stages A, . . . , G and the few accompanying indications make it possible to understand how the command shaft can be driven to select one of the different display functions.

Setting the time

The elements which have just been described make it possible to correct the time displayed by the hands (which corresponds to stage B on the table of FIG. 2). When the watch is in the normal time display means (shown by stage A), the hour correction function is activated by pulling out the shaft. Displacement of the shaft towards the outside causes the interpretation circuit 24 (FIG. 1) to send a signal to the input EN of the electronic control means 22. Reception of this signal by the electronic control means 22 causes the switches 26, 28 to pass into the state b. Simultaneously, the electronic control means 22 emit a high signal on the reset line of the second hand position counter 6 to keep this at zero so that it no longer supplies the incrementing signal of the minute 8 and hour 12 hand position counters.

The interpretation circuit 24 then sends impulses corresponding to the various rotary movements imparted to the shaft by the user to the inputs $D^+$, $D^-$ of the electronic control means 22 which, in turn, emit command impulses for incrementally increasing or decreasing the minute hand 8 and hour hand 12 position counters and to simultaneously command the motors 18, 20 to displace the hands. When the shaft is pushed back in at the end of the operation of setting the time, the interpretation circuit 24 supplies a deactivation signal to the electronic control means 22 which in turn supply a signal via their output C to cause the switches 26, 28 to pass into state a. The reset line simultaneously returns to zero and the second hand position counter 6 starts up again.

Alarm mode

As has already been stated, the timepiece described herein is adapted to perform an alarm function. For this purpose it has two counters 27, 29 (FIG. 1) to memorize the position of the minute hand and that of the hour hand respectively corresponding to the time of sounding of the alarm and a synthesizer circuit of the acoustic signal 30 which is connected to the electronic control means 22.

When the user wishes to consult or adjust the time of the alarm and when he wishes to switch the alarm on or off, he has to carry out a certain number of manipulations of the command shaft. Since a relatively large number of functions can be called up using the command shaft, the succession of manipulations to be carried out can sometimes be long, which necessarily implies a certain risk of error. To overcome this problem, each manipulation of the command shaft is accompanied by displacement of the hands on the dial to inform the user of the effect of the manipulation which he has just carried out. It is obviously important that these indications of the effect of a command are easily comprehensible to the user and unambiguous. It is in particular important that the display of information apart from an indication of the time cannot be confused with an indication of the time. In this context, the display of information apart from the indication of the time by means of the two hands in superposed position, according to the instant invention is particularly advantageous. On the one hand, this mode of display is particularly legible and, on the other hand, it cannot be confused with an indication of the time.

The different functions that can be called up using the command shaft as well as the display functions associated therewith will now be described with reference to FIG. 2.

Entry into the alarm mode

When the watch is in the normal time display mode A (FIG. 2) and when the interpretation circuit 24 (FIG. 1) emits an activation signal to the input AN of the electronic control means 22 corresponding to a pressure exerted on the shaft, the electronic control means 22 emit a signal to their output C to place the switches 26 and 28 in state b (FIG. 1), that is to block the impulses corresponding to the counters 8 and 12 and simultaneously read the contents of the counters 8 and 12 to ascertain the positions of the minute and hour hands. They then emit the requisite number of impulses to the outputs Mmn and Mh to cause the hands to superpose in the position corresponding to the alarm indication on the dial as shown in stage C (this does not affect the operation of the counters 6, 8 and 12). By way of example, if the alarm indication is placed at 9 hours, as is the case in FIG. 2, the electronic control means bring the hands to superpose above the indication "alarm" by emitting a number of impulses equal to the number of impulses which would be necessary to make the contents of both counters 8 and 12 equal to 45.

The indication of entry into the alarm mode by the two hands superposed at 9 hours on the dial is very clear and cannot under any circumstances be confused with an indication of time.

Once the electronic control means 22 have brought the two hands into the position indicating entry into the alarm mode, these remain in the standby mode until they have determined, by counting the impulses of 1 Hz issued from the graduation chain 4, that two seconds have elapsed. If these two seconds have elapsed without the command shaft having been actuated, the electronic control means will cause the watch to display the state of activation of the alarm, stage D (FIG. 2).

Display and change of the state of activation of the alarm

An alarm timepiece always has means for activating and deactivating the acoustic alarm signal. Activating the alarm of an alarm timepiece means that the latter will emit an acoustic signal as soon as the time displayed by the hands in normal time display mode coincides with the programmed alarm time. If, on the contrary, the alarm signal is deactivated, no acoustic signal will be emitted, even if the time displayed by the hands coincides with the programmed alarm time. In the present embodiment, it is the electronic control means 22 which are placed by the user either in a state in which the alarm is on, or in a state in which it is off.

As has already been stated, when the watch fulfils the function of display of the indication of entry into the alarm mode C (FIG. 2), and two seconds have elapsed without the shaft having been actuated, the electronic control means 22 emit the requisite number of impulses to the outputs Mmn and Mh to cause the hands to move together either to the position "ON" or to the position "OFF", corresponding to 8 hours and 10 hours respectively on the dial, depending on whether the alarm is on or off. The position occupied by the two superimposed hands on the dial gives the user perfectly clear information on the state of the alarm of the watch, particularly since this information cannot be confused with an indication of time.

When the alarm watch fulfils the function of display of the state of activation of the alarm, stage D, which has just been described, the user can change the state of the alarm by simply pressing on the shaft. When the interpretation circuit 24 transmits an impulse to the electronic control means 22, indicating to them that pressure has been exerted on the shaft, these emit the requisite number of impulses to cause the two hands to move simultaneously from the "ON" position to the "OFF" position or vice versa, as required.

When, as from the moment that the hands are immobilized either on "ON" or on "OFF", depending on whether the alarm is activated or deactivated, no pressure has been exerted on the shaft for a period of three seconds, the electronic control means 22 command the displacement of the hands to cause these to carry out the function of displaying the preprogrammed alarm time, stage F (FIG. 2).

Display and correction of the alarm time

The respective positions of the minute hand and of the hour hand when these indicate the alarm time are memorized in the counters 27, 29 of the alarm time. To display the alarm time, the electronic control means 22 read the contents of the counters 27, 29 and bring the hands into the positions corresponding to the contents of these counters by supplying each of the motors with a number of impulses equal to the difference between the state of the corresponding alarm time counter and the value 40 or 50 depending on whether the hands were previously in the "ON" or "OFF" position. As soon as the alarm time is displayed, the user has a period of five seconds during which he can pull on the shaft to correct the alarm time, stage G. The correction of the alarm time is effected in a manner similar to the normal correction of the time described hereinabove. Nonetheless, in the present case, it is not the hour hand 12 and the minute hand 8 position counters which are increased by increments when the hands move, but the alarm time counters 27, 29. Once correction of the alarm time has been completed, the user pushes the shaft in again. When the shaft has been pushed in, the interpretation circuit 24 sends a signal to the electronic control means 22 which has two functions, its first function being to activate the alarm so that an acoustic signal is emitted as soon as the hour and minute hand position counters coincide with the alarm time counters. The second function of the signal is to cause the electronic control means 22 to bring the hands into the normal time display mode, stage A, the electronic control means 22 calculate the number of impulses needed to effect this operation by comparing the contents of the hand position counters 8, 12 with the alarm time counters 27, 29.

Alarm and interruption of the alarm

When the watch alarm is in the normal time display mode A and the alarm has been activated, an acoustic signal is emitted, as has already been stated, as soon as the contents of the hand position counters 8, 12 correspond to the contents of the alarm time counters 27, 29. The user can then interrupt the emission of the acoustic alarm signal by exerting pressure on the shaft. The pressure exerted on the shaft causes the interpretation circuit 24 to emit a signal to the electronic control means 22to, on the one hand, interrupt the acoustic signal and, on the other hand, to deactivate the alarm which then, in the absence of a new manipulation by the user, will not emit any acoustic signal the next time the contents of the hand position counters 8, 12 coincide with the alarm time counters 27, 29 twelve hours later.

As has already been stated, the alarm watch which has just been described only constitutes one particular embodiment of the instant invention which has been given by way of example. The invention as defined in claim 1 covers all analog timepieces able to display information apart from an indication of the time by means of hands. For information apart from an indication of the time to be displayed in the manner characterized by the instant invention, is it only necessary firstly for this information to be translated in the form of a numerical value and, secondly, for the electronic control means to have access to this numerical value.

There will now be described, still by way of example, a second embodiment of the instant invention, with particular reference to FIGS. 4 and 5.

Figure 4:
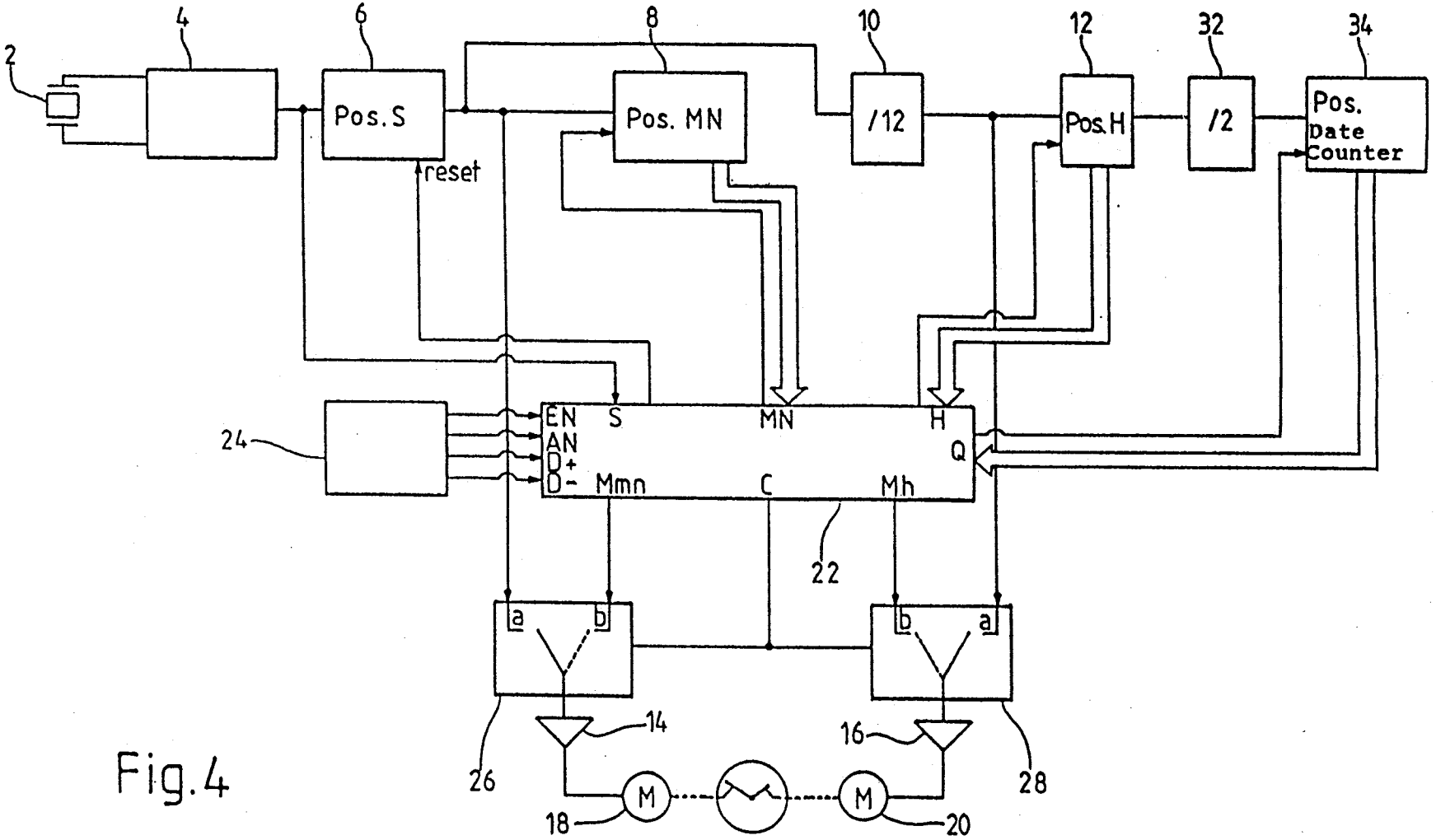
FIG. 4 shows in block diagram form a second embodiment of the instant invention.

FIG. 4 shows in the form of a block diagram a watch having an hour hand and a minute hand and able to indicate either the time in a conventional manner or the date in the manner characterizing the instant invention. This watch comprises a quartz oscillator 2 and a graduation and counting chain similar to that which has been described hereinabove in connection with FIG. 1. To permit the display of the date, the watch shown in FIG. 4 also comprises a divider by two with reference numeral 32 receiving the signal from the hour hand position counter and a date position counter 34, the input of which is connected to the output of the divider 32. The date position counter 34 is similar to the counter 6, 8 and 12 and its mode of operation thus corresponds to that described in the diagram of FIG. 3.

As regards the normal display of the time and of the operation of setting the time, the mode of operation of the watch described herein is identical to that of the alarm which has been described hereinabove. The operation of the watch will now be described with regard to the display and the setting of the date.

If the user exerts pressure on the command shaft, while the hands of the watch display the time in the normal manner, the interpretation circuit 24 emits an activation signal in the direction of input AN of the electronic control means 22. This signal causes the means 22 to emit a signal to their output C to place the switches 26 and 28 in the state b, that is to block the impulses corresponding to the counters 8 and 12. Simultaneously, the electronic control means 22 read the contents of the minute hand position counter 8 and that of the hour hand position counter 12 to compare this with the contents of the date position counter 34 to determine the number of steps to cause each of the motors to perform so as to bring the two hands to superpose on the dial opposite the number corresponding to the day of the month, that is the date, in conformity with what is shown in FIG. 5 (this does not affect the operation of the counters 6, 8, 12, 34).

Figure 5:
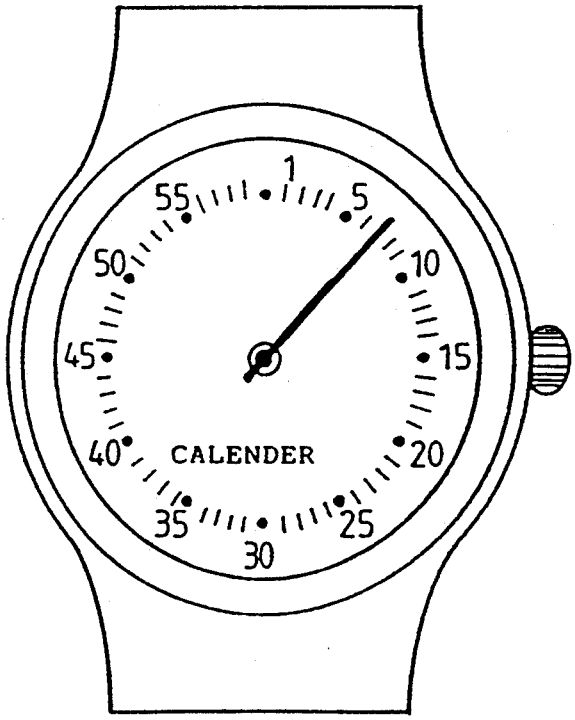
FIG. 5 shows the timepiece of FIG. 4 seen from above with the two hands superposed to indicate the date.

The indication of the date by the two superposed hands is very clear as can be seen from FIG. 5, and can under no circumstances be confused with an indication of the time.

As has already been stated, the date position counter 34 operates in a manner similar to the other position counters 6, 8 and 12. The date position counter is thus notably a counter by sixty which has to be returned to zero manually at the end of each month of 28, 29, 30 or 31 days.

It is now proposed to describe the operation of resetting the indication of the date. When the watch is in the date display mode and the user pulls on the shaft, the interpretation circuit 24 emits a signal to the input EN of the electronic control means 22 to cause them to pass into the date setting mode. The interpretation circuit 24 then transmits to the inputs D+ and D− of the means 22 signals corresponding to the different rotatory movements imparted to the shaft by the user. These signals cause the incremental increase or decrease of the counter of the date position 34 and simultaneously the forwards or backwards displacement of the two hands in superposed position. When the user pushes shaft in again at the end of the date resetting operation, the interpretation circuit 24 emits a signal in the direction of the electronic control means 22. The means 22 will then first of all read the contents of the counters 8 and 12 lo bring the hands into the position corresponding to the current time, and then place the switches 26 and 28 in the state a.

The following are examples of some of the other types of information that may be displayed and that may relate to the instant invention:

the additional information may for example be the day or another time information such as the month or the year.

the information could also for example be the ambient temperature assuming the timepiece is fitted with a heat sensor electrically connected to the electronic control means.

finally, the information apart from the indication of time can be an indication of entry into a special mode of operation of the timepiece, such as the indication "alarm" on the watch alarm described hereinabove which indicates entry into the alarm mode.

I claim:

1. An analog time piece comprising at least an hour hand and a minute hand, respectively driven by first and second electro-mechanical means, manual command means and an electronic circuit providing a time base, a counter circuit giving information on at least the hour and the minute, and electronic control means for generating a command signal for the displacement of the hands, said electronic circuit further comprising means for acquiring, processing and providing said control means with information apart from the time of day, said control means being arranged so as to, in response to a signal generated by said command means, cause said hands to indicate an information other than the time of day, wherein the hands are made to indicate said information other than the time of day by being driven to selectively superpose themselves in an angular position corresponding to said information other than the time of day.

2. An analog timepiece according to claim 1, further comprising a dial having around its periphery indices each being disposed on the axis of said angular position which corresponds to a particular information other than the time of day.

3. An analog time piece according to claim 1, wherein said timepiece is an alarm watch and said information apart from the time of day is either that the alarm is on or that the alarm is off.

* * * * *